US011076702B2

(12) United States Patent
Zhang

(10) Patent No.: US 11,076,702 B2
(45) Date of Patent: Aug. 3, 2021

(54) EASY-ASSEMBLING FOLDING BED

(71) Applicant: Xiangshan Zhang, Zhejiang (CN)

(72) Inventor: Xiangshan Zhang, Zhejiang (CN)

(73) Assignees: Xingfang Jin, Zhejiang (CN); Xiangshan Zhang, Zhejiang (CN)

( * ) Notice: Subject to any disclaimer, the term of this patent is extended or adjusted under 35 U.S.C. 154(b) by 21 days.

(21) Appl. No.: 16/745,386

(22) Filed: Jan. 17, 2020

(65) Prior Publication Data

US 2021/0127844 A1 May 6, 2021

(30) Foreign Application Priority Data

Nov. 4, 2019 (CN) ..... 201921877206.7

(51) Int. Cl.

| | |
|---|---|
| ***A47C 17/64*** | (2006.01) |
| ***A47C 17/70*** | (2006.01) |
| ***A47C 17/68*** | (2006.01) |
| ***A47C 17/74*** | (2006.01) |

(52) U.S. Cl.
CPC ..... *A47C 17/74* (2013.01)

(58) Field of Classification Search
CPC ..... A47C 17/74; A47C 17/64; A47C 17/645; A47C 17/68; A47C 17/70; A47C 17/705; A47C 17/72; A47C 1/143; A47C 4/283
See application file for complete search history.

(56) References Cited

U.S. PATENT DOCUMENTS

| | | | | | |
|---|---|---|---|---|---|
| 20,435 | A * | 6/1858 | Johns | A47C 17/68 | 5/114 |
| 229,421 | A * | 6/1880 | Joslin | A47C 17/68 | 5/112 |
| 229,501 | A * | 6/1880 | Van Dyke | A47C 17/68 | 5/112 |
| 338,349 | A * | 3/1886 | Johnstone | A61G 1/013 | 5/627 |
| 461,691 | A * | 10/1891 | Trenholme | A47C 17/68 | 5/112 |
| 505,409 | A * | 9/1893 | Morrell | A47C 17/68 | 5/112 |
| 514,326 | A * | 2/1894 | Le Dan | A47C 17/68 | 5/112 |
| 537,305 | A * | 4/1895 | Page | A47C 17/68 | 5/112 |

(Continued)

*Primary Examiner* — Peter M. Cuomo
*Assistant Examiner* — Ifeolu A Adeboyejo

(57) ABSTRACT

Disclosed is an easy-assembling folding bed, comprising a bed surface, bed side rods, and a footing component; the rods are disposed in parallel, the footing component is arranged in multiple groups, uniformly disposed and is engaged with the rods; the footing component comprises first and second components. The invention has simple structure, less materials, lighter weight and is convenient to carry. By rotating the second C-shaped engaging piece, the distance between the first and second C-shaped engaging pieces is changed, so the surface is tightened. The locking hook can automatically hook the locking fixing piece and lock it by the reset torsional spring, so the consumer can tighten and lock the surface. By twisting the hook to overcome the torsion of the spring and then rotating, the hook and the fixing piece are disengaged, and the footing component can be easily removed and folded to reduce the packaging volume.

7 Claims, 5 Drawing Sheets

(56) References Cited

U.S. PATENT DOCUMENTS 648,304 A * 4/1900 Routier ..... A47C 17/68 5/112
708,869 A * 9/1902 Davidoff ..... A47C 17/68 5/112
718,159 A * 1/1903 Rundgvist ..... A47C 17/68 5/114
829,589 A * 8/1906 Leavitt ..... A47C 17/68 5/114
879,988 A * 2/1908 Thompson ..... A47C 17/68 5/112
915,182 A * 3/1909 Hyller ..... A47C 17/68 5/112
1,026,016 A * 5/1912 Wilson ..... A47C 17/68 5/112
1,040,815 A * 10/1912 Townsend ..... A47C 17/68 5/112
1,074,954 A * 10/1913 Karpen ..... A47C 17/68 5/180
1,116,562 A * 11/1914 Calmes ..... A47C 17/68 5/114
1,210,605 A * 1/1917 Clough et al. ..... A47C 17/68 5/112
1,223,193 A * 4/1917 Mitchell et al. ..... A47C 17/68 5/114
1,259,732 A * 3/1918 Harpham ..... A47C 17/68 5/112
1,280,042 A * 9/1918 Kaplan ..... A47C 17/68 5/112
1,300,621 A * 4/1919 Key ..... A47C 17/68 5/114
1,306,042 A * 6/1919 Wittmann ..... A47C 17/68 5/112
1,334,091 A * 3/1920 Hall ..... A47C 17/68 5/117
1,357,578 A * 11/1920 Mieczejeski ..... A47C 17/74 5/176.1
1,400,049 A * 12/1921 Goddard ..... A45F 3/22 5/128
1,422,320 A * 7/1922 Stoll ..... A47C 17/68 5/114
1,518,386 A * 12/1924 Brower ..... A47C 19/126 5/117
1,678,441 A * 7/1928 McGrew ..... A47C 17/68 5/112
1,869,060 A * 7/1932 Harter ..... A47C 17/68 403/113
2,043,854 A * 6/1936 Broberg ..... A47C 17/68 5/114
2,757,386 A * 8/1956 Lappin ..... A61G 1/056 5/8
3,029,115 A * 4/1962 Rachman ..... A47B 3/087 108/129
3,029,448 A * 4/1962 Ball ..... A47C 17/645 5/114
3,044,080 A * 7/1962 Hartwig ..... A47C 17/68 5/111
3,105,976 A * 10/1963 Roche ..... F16B 12/52 5/285
3,134,987 A * 6/1964 Bertram ..... A47C 17/705 5/111
3,462,773 A * 8/1969 Triplett ..... A47D 5/006 5/111
3,956,781 A * 5/1976 Reemelin ..... A47C 17/705 5/114
3,965,502 A * 6/1976 Bertram ..... A47C 17/645 5/111
4,012,800 A * 3/1977 Mitchell ..... A23B 7/148 5/187
4,594,743 A * 6/1986 Owen ..... A47C 17/70 5/111
5,429,413 A * 7/1995 Levy ..... A47C 1/143 297/16.2
5,529,270 A * 6/1996 Liu ..... A47C 17/68 248/166
6,553,586 B1 * 4/2003 Lin ..... A47C 17/64 5/114
6,581,223 B1 * 6/2003 Wang ..... A47C 17/72 5/111
6,817,047 B2 * 11/2004 Brodeur ..... A47D 7/02 5/110
8,656,531 B1 * 2/2014 Holmes ..... A47C 5/06 5/110
8,806,675 B2 * 8/2014 Lah ..... A47C 19/00 5/111
8,919,284 B2 * 12/2014 Wolfe, Jr. ..... A01K 1/0353 119/28.5
10,888,172 B2 * 1/2021 Xia ..... A47C 19/122
2007/0095990 A1 * 5/2007 Park ..... A47C 17/70 248/200
2008/0127413 A1 * 6/2008 Flannery ..... A47C 17/72 5/111
2008/0295246 A1 * 12/2008 Yul ..... A47C 17/16 5/12.2
2009/0178195 A1 * 7/2009 Zheng ..... A47C 19/126 5/111
2010/0181459 A1 * 7/2010 Wang ..... A47C 19/126 248/419
2012/0047649 A1 * 3/2012 Grace ..... A47C 17/64 5/110
2012/0317717 A1 * 12/2012 Jin ..... E04H 15/02 5/110
2014/0115780 A1 * 5/2014 Lah ..... A47C 19/00 5/111
2014/0250593 A1 * 9/2014 Kim ..... A47C 17/645 5/114
2016/0058198 A1 * 3/2016 Yang ..... A47C 17/72 5/111
2016/0198857 A1 * 7/2016 Grace ..... A45F 4/06 5/111
2017/0065090 A1 * 3/2017 Yang ..... A47C 17/705
2017/0196363 A1 * 7/2017 Ray ..... A47C 31/00
2018/0014654 A1 * 1/2018 Yang ..... A47C 17/68
2018/0027976 A1 * 2/2018 Leng ..... A47C 23/0507
2020/0146459 A1 * 5/2020 Yang ..... A47C 17/76

* cited by examiner

EASY-ASSEMBLING FOLDING BED

BACKGROUND OF THE INVENTION

1. Field of the Invention

The invention relates to the technical field of beds, in particular to an easy-assembling folding bed.

2. Description of the Related Art

The folding bed is a simple bed that can be folded and retracted by various folding methods for the convenience and space saving. The bed has the characteristics of small size and easy to carry after folding. With the improvement of people's living standards, more and more people use folding beds in outdoor recreation, camping, etc. With the development of technology, people have higher and higher requirements for folding beds: it is hoped that the usage and folding process of the folding bed could be more and more simple and convenient, and the weight be lighter.

SUMMARY OF THE INVENTION

In order to solve the technical issues above, the invention provides the technical solutions as follows: an easy-assembling folding bed, comprising a bed surface, bed side rods, and a footing component, wherein the bed side rods are disposed in parallel on the two sides of the long side of the bed surface and are connected thereto, and the footing component is arranged in multiple groups and uniformly disposed under the bed surface and is engaged with the bed side rods; the footing component comprises a first component and a second component that are oppositely disposed and connected; the first component comprises a first C-shaped engaging piece, a first L-shaped supporting rod fixedly connected to one side of the first C-shaped engaging piece, and a first supporting leg connected to the bottom of the first C-shaped engaging piece; the second component comprises a second C-shaped engaging piece, a second L-shaped supporting rod hinged to one side of the second C-shaped engaging piece, and a second supporting leg connected to the bottom of the second C-shaped engaging piece; the first L-shaped supporting rod and the opposite end of the second L-shaped supporting rod are connected via an elastic cord; the second component is further provided with a locking fixing piece, a locking hook, and a reset torsional spring; the top of the second C-shaped engaging piece is hinged to the end of the second L-shaped supporting rod, and the bottom thereof is hinged with the locking hook by the reset torsional spring; the locking fixing piece is disposed on the second L-shaped supporting rod and corresponding to the position of the locking hook, so that the locking hook is engaged and locked with the locking hook under the torsion of the reset torsional spring.

As an improvement, the top of the first C-shaped engaging piece is a first C-shaped groove engaged with the bed side rod, the bottom thereof is a first cylindrical groove which is inserted with the first supporting leg, and the inner side thereof is provided with a first engaging groove connected to the first L-shaped supporting rod; the first engaging groove is a hollow trapezoidal groove which is formed in a triangular shape on the side panel, and the first engaging groove is fixedly connected to the end of the first L-shaped supporting rod.

As an improvement, the top of the second C-shaped engaging piece is a second C-shaped groove engaged with the bed side rod, the bottom thereof is a second cylindrical groove which is inserted with the second supporting leg, and the inner side thereof is provided with a second engaging groove connected to the second L-shaped supporting rod; the second engaging groove is a hollow groove in which the side panel is arranged to be connected by two C-shaped panels; one end of the second engaging groove adjacent to the second C-shaped groove is provided with a first hinge hole for hinged connection with the second L-shaped supporting rod, and the other end thereof is provided with a second hinge hole for hinged with the locking hook and the reset torsional spring.

As an improvement, the first C-shaped groove and the second C-shaped groove in the first C-shaped engaging piece and the second C-shaped engaging piece are engaged with the bed side rods, and the grooves are respectively facing the end of the first C-shaped engaging piece and the second C-shaped engaging piece away from the first L-shaped supporting rod and the second L-shaped supporting rod.

As an improvement, the first supporting leg and the second supporting leg are cylindrical in parallel with each other, and the bottom thereof are all provided with a non-slip pad.

As an improvement, the first L-shaped supporting rod and the second L-shaped supporting rod are in hollow structure, and the inside thereof are connected via an elastic cord; the end of the first L-shaped supporting rod is provided with an inserting end connected to the second L-shaped supporting rod.

As an improvement, the first component and the second component are disposed on a same plane perpendicular to the bed side rods.

After adopting the structure above, the invention has the following advantageous: the invention has simple structure, less materials, lighter weight and is convenient for consumers to carry. By rotating the second C-shaped engaging piece hinged to the second L-shaped supporting rod, the distance between the first C-shaped engaging piece and the second C-shaped engaging piece is changed by the lever principle, so that the bed surface is tightened. The locking hook can automatically hook the locking fixing piece and lock it by the reset torsional spring, so that the consumer can tighten and lock the bed surface. By twisting the locking hook to overcome the torsion of the torsional spring and then rotating around the rotation point, the locking hook and the locking fixing piece are disengaged, and the footing component under the bed surface can be easily removed and folded to reduce the packaging volume.

Figure 1:
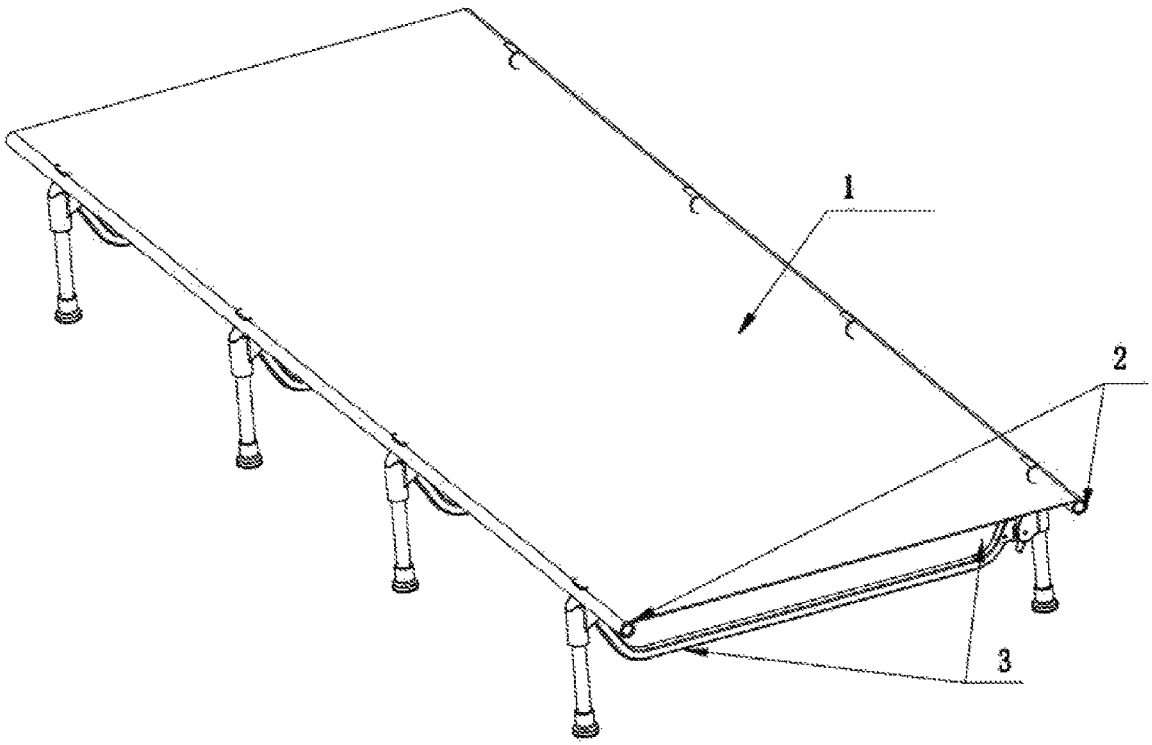
FIG. 1 is a schematic view illustrating the structure of the easy-assembling folding bed of the invention.
Figure 2:
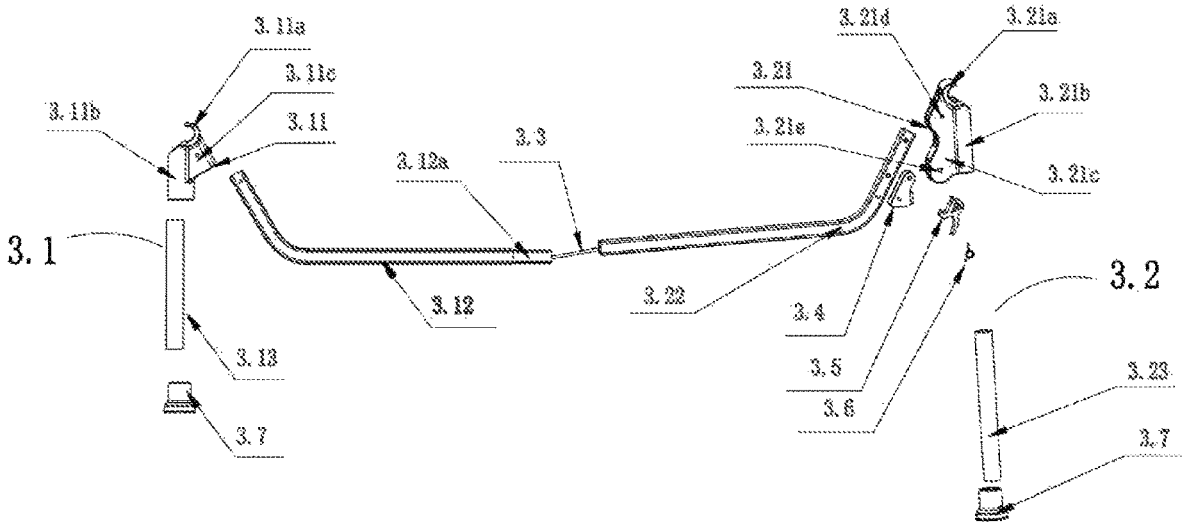
FIG. 2 is a schematic view illustrating the structure of the footing component of the easy-assembling folding bed of the invention.

In the figures: 1 refers to the bed surface; 2 refers to the bed side rod; 3 refers to the footing component; 3.1 refers to the first component; 3.11 refers to the first C-shaped engaging piece; 3.11*a* refers to the first C-shaped groove; 3.11*b* refers to the first cylindrical groove; 3.11*c* refers to the first engaging groove; 3.12 refers first to the L-shaped supporting rod; 3.12*a* refers to the inserting end; 3.13 refers to the first supporting leg; 3.2 refers to the second component; 3.21 refers to the second C-shaped engaging piece; 3.21*a* refers to the second C-shaped groove; 3.21*b* refers to the second cylindrical groove; 3.21*c* refers to the second engaging groove; 3.21*d* refers to the first hinge hole; 3.21*e* refers to the second hinge hole; 3.22 refers to the second L-shaped supporting rod; 3.23 refers to the second supporting leg; 3.4 refers to the locking fixing piece; 3.5 refers to the locking hook; 3.6 refers to the reset torsional spring; 3.7 refers to the non-slip pad.

DETAILED DESCRIPTION OF THE PREFERRED EMBODIMENTS

With reference to FIG. 1-7, an easy-assembling folding bed, comprising a bed surface 1, bed side rods 2, and a footing component 3, wherein the bed side rods 2 are disposed in parallel on the two sides of the long side of the bed surface 1 and are connected thereto, and the footing component 3 is arranged in multiple groups and uniformly disposed under the bed surface 1 and is engaged with the bed side rods 2; the footing component 3 comprises a first component 3.1 and a second component 3.2 that are oppositely disposed and connected; the first component 3.1 comprises a first C-shaped engaging piece 3.11, a first L-shaped supporting rod 3.12 fixedly connected to one side of the first C-shaped engaging piece 3.11, and a first supporting leg 3.13 connected to the bottom of the first C-shaped engaging piece 3.11; the second component 3.2 comprises a second C-shaped engaging piece 3.21, a second L-shaped supporting rod 3.22 hinged to one side of the second C-shaped engaging piece 3.21, and a second supporting leg 3.23 connected to the bottom of the second C-shaped engaging piece 3.21; the first L-shaped supporting rod 3.12 and the opposite end of the second L-shaped supporting rod 3.22 are connected via an elastic cord 3.3; the second component 3.2 is further provided with a locking fixing piece 3.4, a locking hook 3.5, and a reset torsional spring 3.6; the top of the second C-shaped engaging piece 3.21 is hinged to the end of the second L-shaped supporting rod 3.22, and the bottom thereof is hinged with the locking hook 3.5 by the reset torsional spring 3.6; the locking fixing piece 3.4 is disposed on the second L-shaped supporting rod 3.22 and corresponding to the position of the locking hook 3.5, so that the locking hook 3.5 is engaged and locked with the locking hook 3.5 under the torsion of the reset torsional spring 3.6.

Preferably, the top of the first C-shaped engaging piece 3.11 is a first C-shaped groove 3.11*a* engaged with the bed side rod, the bottom thereof is a first cylindrical groove 3.11*b* which is inserted with the first supporting leg 3.13, and the inner side thereof is provided with a first engaging groove 3.11*c* connected to the first L-shaped supporting rod 3.12; the first engaging groove 3.11*c* is a hollow trapezoidal groove which is formed in a triangular shape on the side panel, and the first engaging groove 3.11*c* is fixedly connected to the end of the first L-shaped supporting rod 3.12.

Preferably, the top of the second C-shaped engaging piece 3.21 is a second C-shaped groove 3.21*a* engaged with the bed side rod 2, the bottom thereof is a second cylindrical groove 3.21*b* which is inserted with the second supporting leg 3.23, and the inner side thereof is provided with a second engaging groove 3.21*c* connected to the second L-shaped supporting rod 3.22; the second engaging groove 3.21*c* is a hollow groove in which the side panel is arranged to be connected by two C-shaped panels; one end of the second engaging groove 3.21*c* adjacent to the second C-shaped groove 3.21*a* is provided with a first hinge hole 3.21*d* for hinged connection with the second L-shaped supporting rod 3.22, and the other end thereof is provided with a second hinge hole 3.21*e* for hinged with the locking hook 3.5 and the reset torsional spring 3.6.

Preferably, the first C-shaped groove 3.11 and the second C-shaped groove 3.21 in the first C-shaped engaging piece 3.1 and the second C-shaped engaging piece 3.2 are engaged with the bed side rods 2, and the grooves are respectively facing the end of the first C-shaped engaging piece 3.11 and the second C-shaped engaging piece 3.21 away from the first L-shaped supporting rod 3.12 and the second L-shaped supporting rod 3.22.

Preferably, the first supporting leg 3.13 and the second supporting leg 3.23 are cylindrical in parallel with each other, and the bottom thereof are all provided with a non-slip pad 3.7.

Preferably, the first L-shaped supporting rod 3.12 and the second L-shaped supporting rod 3.22 are in hollow structure, and the inside thereof are connected via an elastic cord 3.3; the end of the first L-shaped supporting rod 3.12 is provided with an inserting end 3.12*a* connected to the second L-shaped supporting rod 3.22.

Preferably, the first component 3.1 and the second component 3.2 are disposed on a same plane perpendicular to the bed side rods 2.

Figure 3:
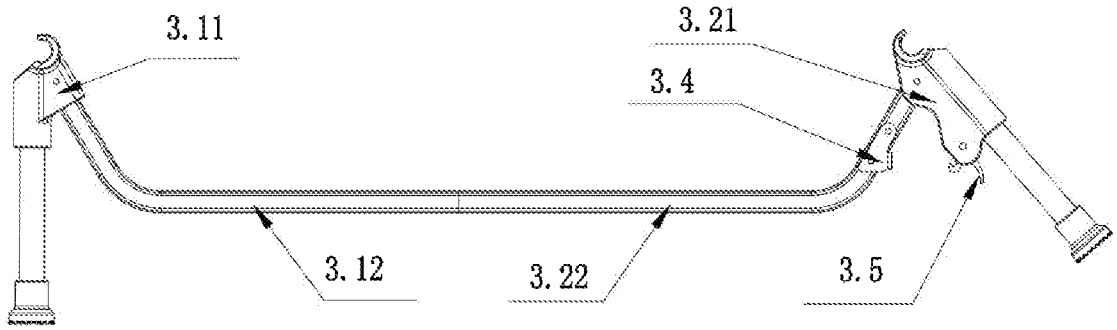
FIG. 3 is a schematic view illustrating the structure of the footing component in an unlocked state of the easy-assembling folding bed of the invention.
Figure 4:
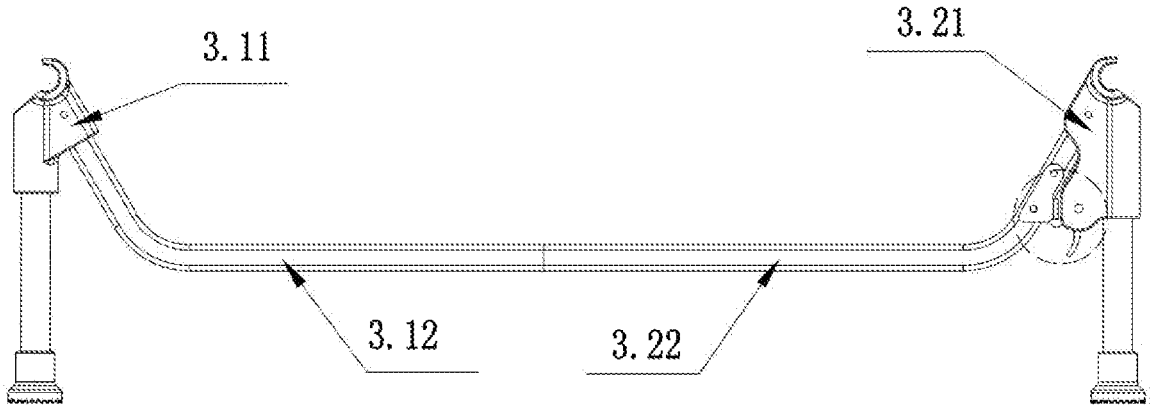
FIG. 4 is a schematic view illustrating the structure of the footing component in a locked state of the easy-assembling folding bed of the invention.
Figure 5:
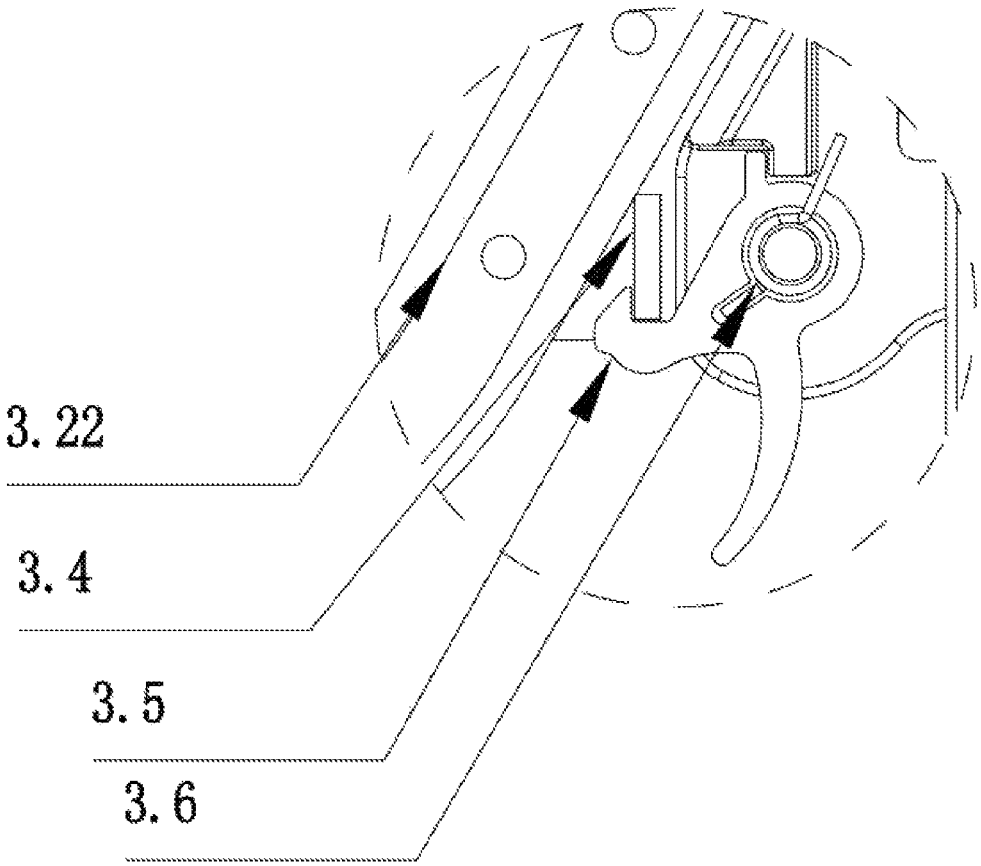
FIG. 5 is a sectional view illustrating the footing component in a locked state of the easy-assembling folding bed of the invention.
Figure 6:
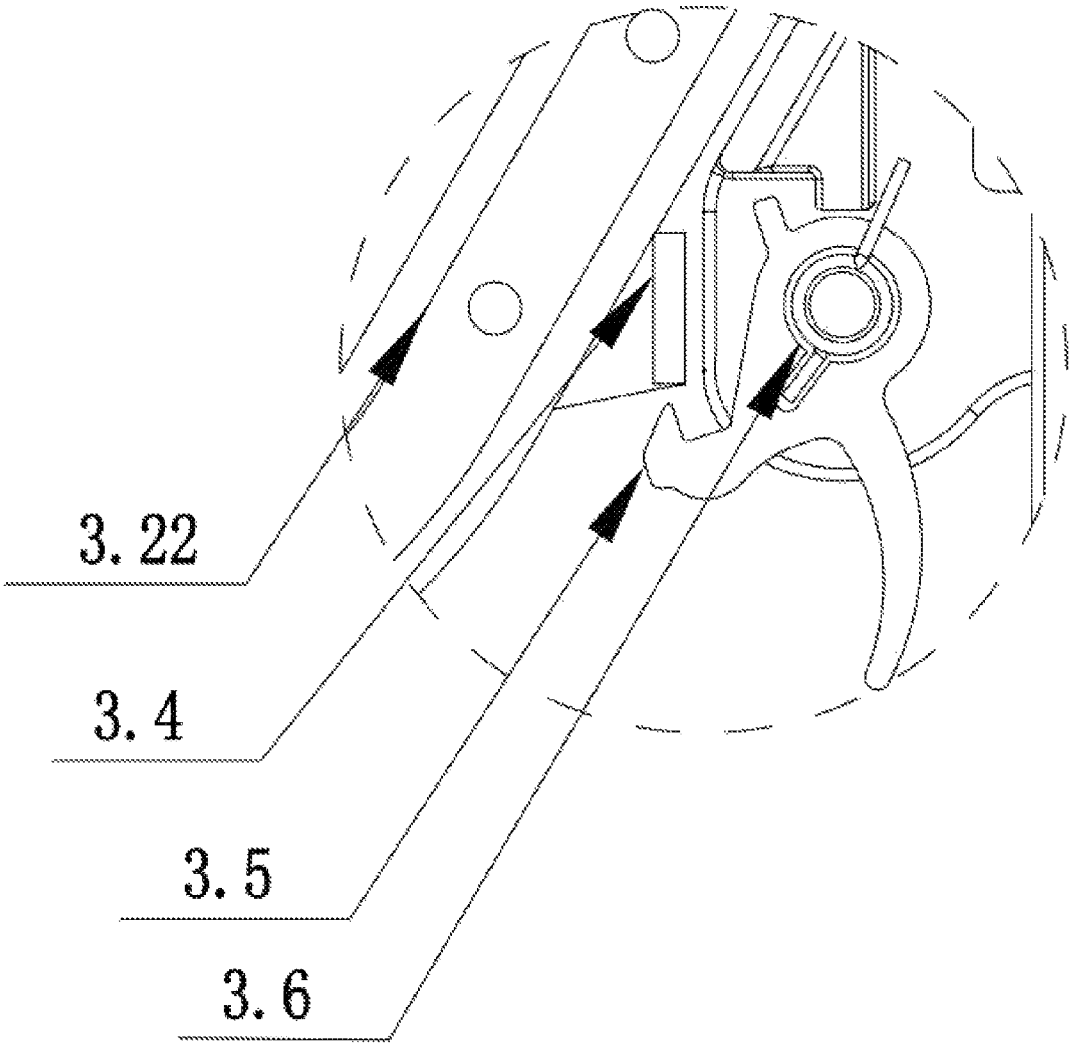
FIG. 6 is a sectional view illustrating the footing component in an unlocked state of the easy-assembling folding bed of the invention.
Figure 7:
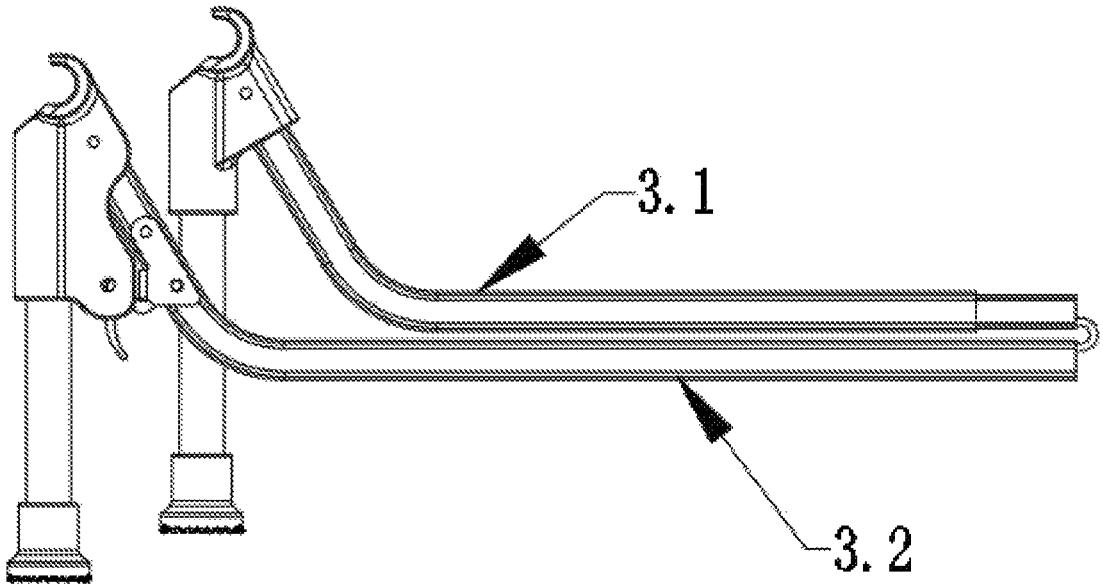
FIG. 7 is a schematic view illustrating the structure of the footing component in a folded state of the easy-assembling folding bed of the invention.

When the invention is in specific implementation, the bed side rod is placed in the engaging groove; with reference to FIG. 3, the direction of the blank arrow on the right side is the direction of the force, and the inward pressure is applied to the second supporting leg on the second component, so that the second C-shaped engaging piece rotates around the hinge point of the second C-shaped engaging piece and the second L-shaped supporting rod, which increases the distance between the first C-shaped engaging piece and the second C-shaped engaging piece, pushes the bed side rods to open, thereby tightening the bed surface; the locking hook hooks the locking fixing piece by the torsion of the reset torsional spring and locks it to complete the assembly of the folding bed. When the invention is in disassembling, the locking hook is twisted to overcome the torsion of the torsional spring and then rotated around the rotation point, the locking hook and the locking fixing piece are disengaged, and the external pressure is applied to the second supporting leg of the second component; the second C-shaped engaging piece is rotated around the hinge point of the second C-shaped engaging piece and the second L-shaped supporting rod to reduce the distance between the first C-shaped engaging piece and the second C-shaped engaging piece; the bed side rod is disengaged from the engaging groove to unlock the footing component and disassemble from the bed surface. The invention has simple structure, less materials, lighter weight and is convenient for disassembling, and the bed surface can be tightened; after the footing component is detached from the bed surface, the first L-shaped supporting rod is pulled out from the second L-shaped supporting rod and folded to reduce the volume of the component, thereby reducing the packaging volume of the bed.

The invention and the embodiments thereof have been described above, and the description is not limited thereto; only one of the embodiments of the invention is illustrated in the drawings, and the actual structure is not limited thereto. Any structural manners and embodiments similar to the technical solution of the invention made by those of ordinary skill in the art who are inspired by the invention without creative efforts shall all fall within the protection scope of the invention.

The invention claimed is:

1. An easy-assembling folding bed, comprising a bed surface, bed side rods, and a footing component, wherein the bed side rods are disposed in parallel on the two sides of the long side of the bed surface and are connected thereto, and the footing component is arranged in multiple groups and uniformly disposed under the bed surface and is engaged with the bed side rods; the footing component comprises a first component and a second component that are oppositely disposed and connected; the first component comprises a first C-shaped engaging piece, a first L-shaped supporting rod fixedly connected to one side of the first C-shaped engaging piece, and a first supporting leg connected to the bottom of the first C-shaped engaging piece; the second component comprises a second C-shaped engaging piece, a second L-shaped supporting rod hinged to one side of the second C-shaped engaging piece, and a second supporting leg connected to the bottom of the second C-shaped engaging piece; the first L-shaped supporting rod and the opposite end of the second L-shaped supporting rod are connected via an elastic cord; the second component is further provided with a locking fixing piece, a locking hook, and a reset torsional spring; the top of the second C-shaped engaging piece is hinged to the end of the second L-shaped supporting rod, and the bottom thereof is hinged with the locking hook by the reset torsional spring; the locking fixing piece is disposed on the second L-shaped supporting rod and corresponding to the position of the locking hook, so that the locking hook is engaged and locked with the locking hook under the torsion of the reset torsional spring.

2. The easy-assembling folding bed according to claim 1, wherein the top of the first C-shaped engaging piece is a first C-shaped groove engaged with the bed side rod, the bottom thereof is a first cylindrical groove which is inserted with the first supporting leg, and the inner side thereof is provided with a first engaging groove connected to the first L-shaped supporting rod; the first engaging groove is a hollow trapezoidal groove which is formed in a triangular shape on the side panel, and the first engaging groove is fixedly connected to the end of the first L-shaped supporting rod.

3. The easy-assembling folding bed according to claim 1, wherein the top of the second C-shaped engaging piece is a second C-shaped groove engaged with the bed side rod, the bottom thereof is a second cylindrical groove which is inserted with the second supporting leg, and the inner side thereof is provided with a second engaging groove connected to the second L-shaped supporting rod; the second engaging groove is a hollow groove in which the side panel is arranged to be connected by two C-shaped panels; one end of the second engaging groove adjacent to the second C-shaped groove is provided with a first hinge hole for hinged connection with the second L-shaped supporting rod, and the other end thereof is provided with a second hinge hole for hinged with the locking hook and the reset torsional spring.

4. The easy-assembling folding bed according to claim 1, wherein the first C-shaped groove and the second C-shaped groove in the first C-shaped engaging piece and the second C-shaped engaging piece are engaged with the bed side rods, and the grooves are respectively facing the end of the first C-shaped engaging piece and the second C-shaped engaging piece away from the first L-shaped supporting rod and the second L-shaped supporting rod.

5. The easy-assembling folding bed according to claim 1, wherein the first supporting leg and the second supporting leg are cylindrical in parallel with each other, and the bottom thereof are all provided with a non-slip pad.

6. The easy-assembling folding bed according to claim 1, wherein the first L-shaped supporting rod and the second L-shaped supporting rod are in hollow structure, and the inside thereof are connected via an elastic cord; the end of the first L-shaped supporting rod is provided with an inserting end connected to the second L-shaped supporting rod.

7. The easy-assembling folding bed according to claim 1, wherein the first component and the second component are disposed on a same plane perpendicular to the bed side rods.

* * * * *